US005966752A

United States Patent [19]

Abugideiri

[11] Patent Number: 5,966,752

[45] Date of Patent: Oct. 19, 1999

[54] BABY BATHTUB AND SHOWER

[76] Inventor: Fatima Abugideiri, 204 Hawkins La., Sterling, Va. 20165

[21] Appl. No.: 09/005,459

[22] Filed: Jan. 12, 1998

Related U.S. Application Data

[60] Provisional application No. 60/035,632, Jan. 16, 1997.

[51] Int. Cl.[6] ..... A47K 3/024

[52] U.S. Cl. ..... 4/572.1; 4/568; 4/573.1; 4/567

[58] Field of Search ..... 4/572.1, 546, 547, 4/552, 560.1, 568, 569, 570, 571.1, 573.1

[56] References Cited

U.S. PATENT DOCUMENTS

| | | | |
|---|---|---|---|
| 1,339,593 | 5/1920 | Booth | 4/569 |
| 1,758,071 | 5/1930 | Bleustein | 4/572.1 |
| 1,964,387 | 6/1934 | Sena | 4/569 |
| 2,100,186 | 11/1937 | Hagopian | 4/569 |
| 2,714,725 | 8/1955 | Boone | 4/569 |
| 5,181,284 | 1/1993 | Raphael et al. | 4/572.1 |
| 5,276,926 | 1/1994 | Lopez | 4/572.1 |

*Primary Examiner*—David J. Walczak

[57] ABSTRACT

A baby bath including a tub and a showerhead. The baby bath also includes a hose capable of connecting to a water source allowing for a flow of water. The hose may be located in a circumference of the tub or connected to the showerhead.

9 Claims, 5 Drawing Sheets

BABY BATHTUB AND SHOWER

This application claims benefits of Provisional application No. 60/035,632 filed Jan. 16, 1997.

BACKGROUND OF THE INVENTION

This invention relates to bathing a baby and in particular, bathing the baby using a combination of a baby bathtub and a baby shower.

A popular technique of bathing an infant utilizes filling an oval-type basin with water and placing the baby therein. There are many hazards and inconveniences associated with bathing the baby using this method. To name a few, the baby may become slippery and difficult to handle and the baby's head may become submerged below the surface of the water. To diminish these hazards, a person bathing the infant uses his/her arm to support the baby. However, this makes it difficult to wash and rinse the baby since one hand is used as a support. During the course of the bath, the water in the conventional basin is not changed since the act of waiting for the existing water to drain and for the tub to be replenished is tedious. In addition, post delivery mothers are recuperating from delivery. Thus, they want the care of their newborns to be simple, efficient, and sanitary.

SUMMARY OF THE INVENTION

This invention provides a way for a person bathing the infant to do so in a simple, efficient, and sanitary method. The babytub/shower allows for a flow of water from a facet into a hose incorporated in a circumference of the baby bathtub or a hand-held showerhead. At a foot of the baby bathtub, drainage holes are placed to allow for removal of dirty water into a sink.

Initially, the baby is placed on an adjustable incline board which is covered with a removable terrycloth towel. The terrycloth towel prevents the baby from slipping and sliding in the tub. Once the bath is complete, the towel can be machine washed to maintain a hygienic environment. The towel hugs the inclined board which can be either elevated or laid flat depending on the size of the infant. The inclined board can be elevated or reclined by placing the board on the appropriate notch at the bottom of the basin.

There are two ways to direct the water through (i) a hand-held showerhead and (ii) a peripheral shower located on sides of the tub. The showerhead may be used to control where the water flows, thus facilitating tasks such as shampooing the baby's hair and rinsing soap residue off the baby's body. To achieve a uniform flow of water into the tub, the peripheral shower may be used. The angle at which the peripheral shower directs water flow may be adjusted depending on the size of the baby.

The baby bathtub is designed such that no water accumulates in the basin, thereby reducing the risk of drowning, while keeping the environment sanitary. The water escapes through drainage holes located at the foot of the inclined board.

Furthermore, during the bathing process, the baby is not solely supported by someone's arm. Instead, a hand can be used to secure the infant on the inclined board by placing a hand on the chest/stomach of the infant while the other hand can manipulate the jets, showerhead and complete the bathing process.

DESCRIPTION OF THE PREFERRED EMBODIMENTS

Figure 1:
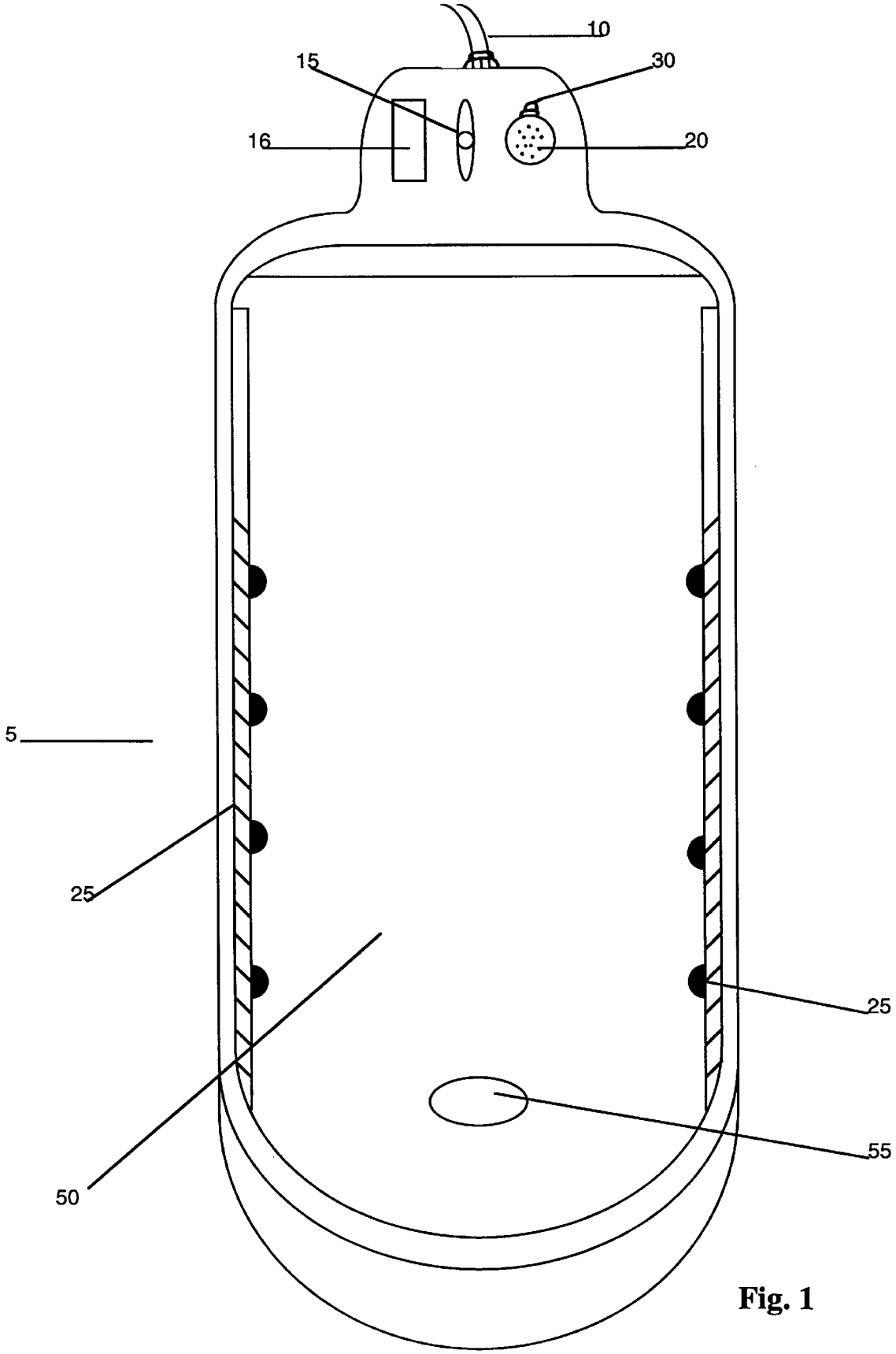
FIG. 1 is an top view of a baby bathtub.
Figure 2:
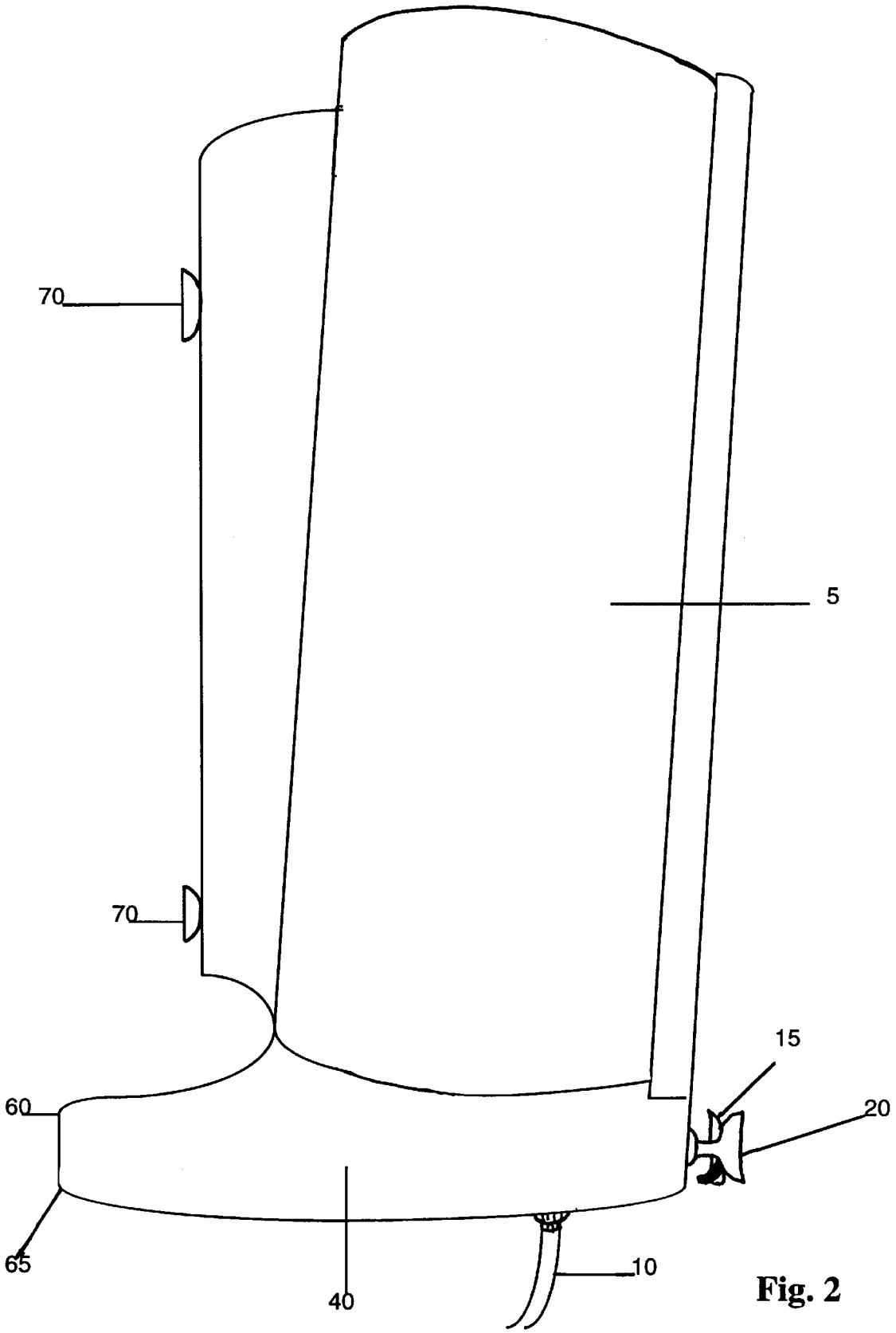
FIG. 2 is a side view of the baby bathtub of FIG. 1.
Figure 3:
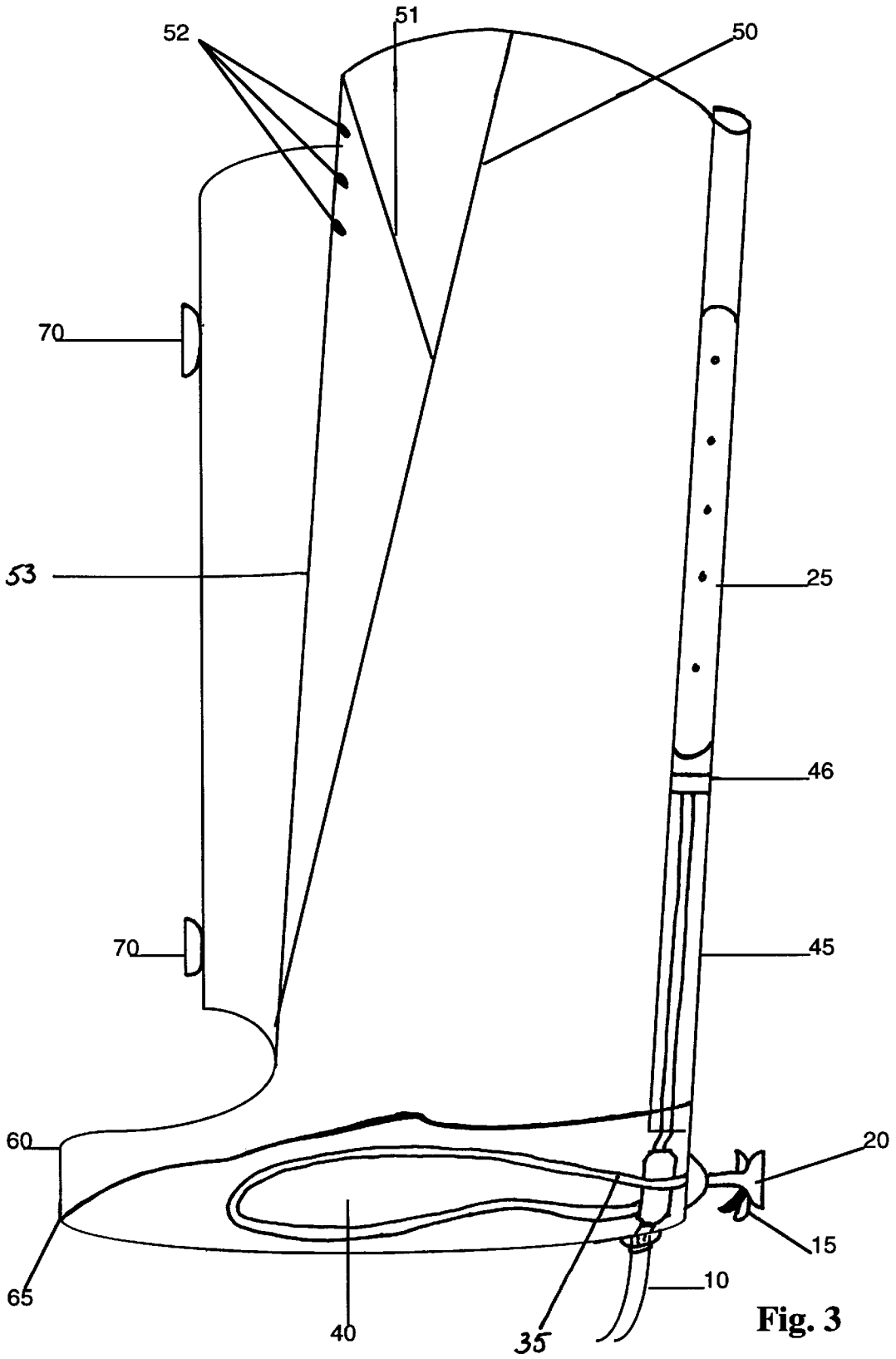
FIG. 3 is a cross-sectional side view of the baby bathtub of FIG. 1.

FIGS. 1–3 illustrate a baby bathtub/shower 5. A water source for the baby bathtub 5 is a faucet (not shown). The faucet is fitted with an adapter (not shown) in which the water is directed into an inlet hose 10. The inlet hose is connected to a valve 15 that controls the flow of water to either a shower head 20 or a peripheral shower 25. Next to the valve 15 is a recessed area 16 that can be used to hold soap, or any other bathing products. The shower head 20 is activated by squeezing a trigger 30. The shower head 20 is connected to a retractable hose 35 which can be pulled out of its compartment 40 as needed. When water is not directed through the shower head 20, it flows into a hose 45. The hose 45 is connected to the peripheral shower 25.

An adjustable incline board 50 supports the baby during the bathing process. The adjustable incline board 50 may be adjusted using a cut-out handle 55 at the head of the incline board 50. There is no accumulation of bath water in the bathtub 5 during the bathing process since there are drainage holes 60 located at the foot of the incline board 50.

A retractable hose compartment 40 and the drainage holes 60 are separated from one another as shown in FIG. 3. The hose compartment 40 and drainage area 60 decline below (no more than 4 inches) the base of the bathtub 5. By declining below the base, a person is able to easily remove bath water into a sink. To ensure that there is no water build-up in the hose compartment 40, drainage holes 65 are provided here as well.

Figure 5:
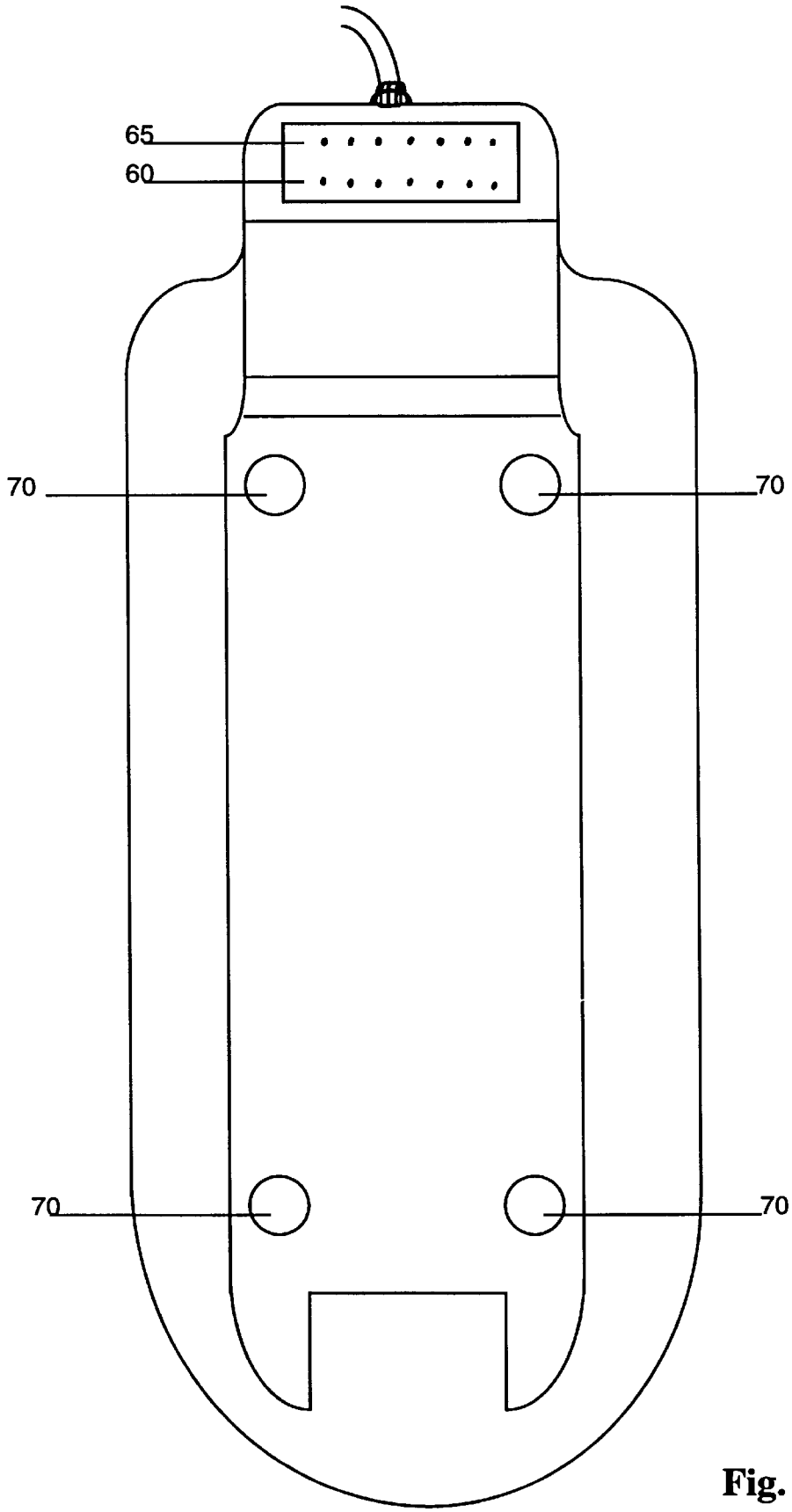
FIG. 5 illustrates an underside view of the baby bathtub of FIG. 1.

FIG. 5 illustrates the bottom of the bathtub 5. Located underneath the bathtub 5 are four suction cups 70 that secure the position of the bathtub 5 on a surface. In this view, the drainage holes 60, 65 for the bathtub 5 and the hose compartment 40 are also visible.

Figure 4B:
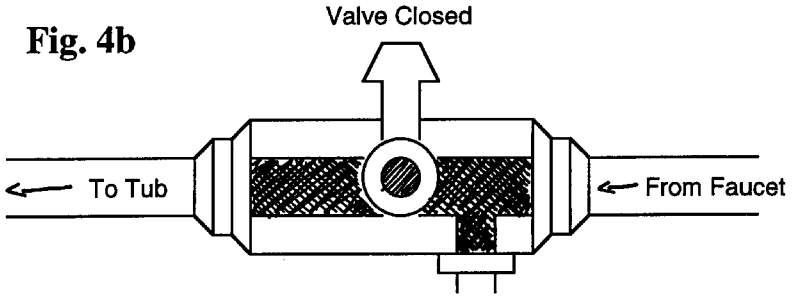
FIGS. 4*a*–4*c* illustrate a water inlet control valve of the baby bathtub of FIG. 1.
Figure 4A:
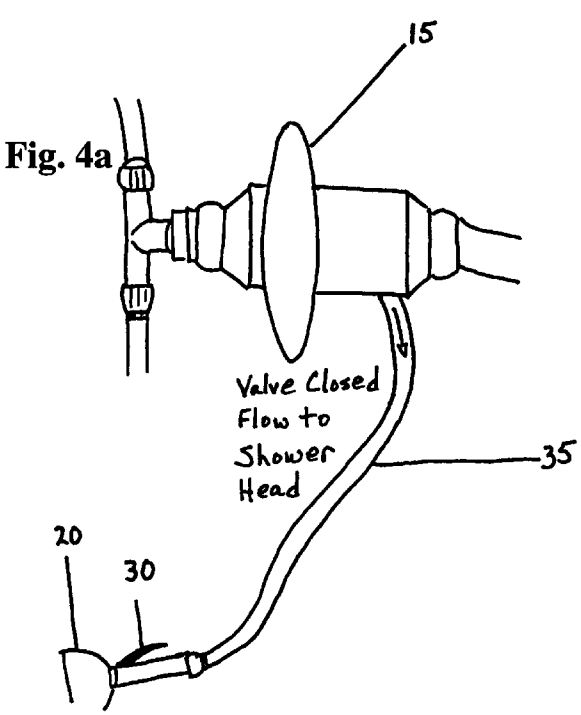
Figure 4C:
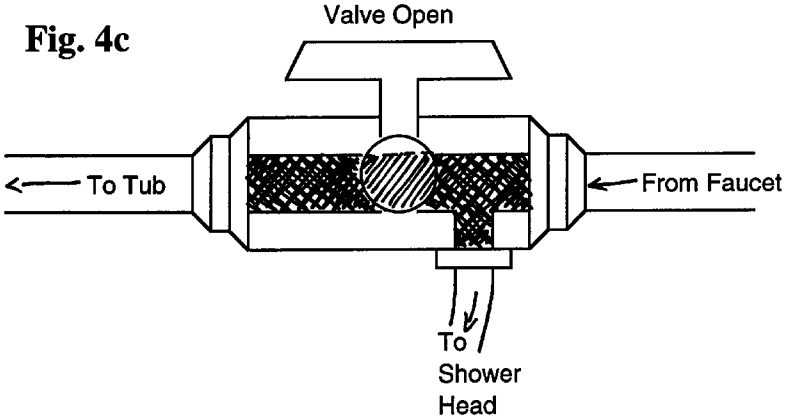

FIG. 3 illustrates that water flows from the inlet hose 10 to the valve 15. FIGS. 4*a*–4*c* shows the various operations of the valve 15. FIG. 4*a* illustrates the valve 15 in a closed position, as well as, the retractable hose 35 connections to the valve 15. FIG. 4*b* shows the valve 15 also in the closed position and FIG. 4*c* illustrates the valve 15 in an open position. When the valve 15 is in the closed position, it directs the water to the hand-held showerhead 20. When the valve 15 is in the open position, it directs the water into the hose 45 located in a hollow rim at the base of the bathtub 5 and to the peripheral shower 25. A connection 46 between the hose 45 and the peripheral shower 25 allows for the angle adjustment of the peripheral shower 25.

During the bathing process, the baby is placed on the inclined board 50. The incline board 50 is attached to a support 51. The incline board 50 can be adjusted to various elevations using the cut-out handle 55 and the support 51. The support 51 rests against notches 52 to produce the desired elevation. The notches 52 rest on a base 53 of the bathtub 5. The angle at which to place the support 51 depends on the size of the baby. Due to a slight grade of the floor of the bathtub 5, the bath water will flow into the drainage holes 60 located at the foot of the bathtub 5 and out into the sink.

Other embodiments are within the scope of the following claims:

What is claimed is:

1. A baby bath comprising:

a tub, wherein a first hose is located around at least a portion of a circumference of said tub;

a showerhead, wherein a second hose is connected said showerhead;

a valve, a hose connected to the valve at one end and adapted to be connected to a water source at the other end allowing for flow of water to said valve, wherein said valve positions direct water to either the tub or the showerhead; and securing means positioned beneath said tub to thereby enable said tub to be adapted to be securely positioned on a surface and easily removable from the surface and securely repositionable on another surface.

2. The baby bath of claim 1, wherein said tub includes drainage holes for removal of water.

3. The baby bath of claim 2, wherein said drainage holes are located in a hose compartment that extends below a base of said tub.

4. The baby bath of claim 1, further comprising an adjustable incline board.

5. The baby bath of claim 4, wherein said adjustable incline board can be elevated or reclined by placing the board on an appropriate notch located in the tub.

6. The bay bath of claim 1, wherein said hose located in the circumference of the tub can be adjusted to change the direction of the water flowing from said first hose.

7. The baby bath of claim 1, wherein said securing means includes suction cups located beneath the tub.

8. The baby bath of claim 1, wherein said valve is in a close position, the water is directed into the second hose connected to the showerhead.

9. The baby bath of claim 1, wherein said valve is in a open position, the water is directed into the first hose located in the circumference of the tub.

* * * * *